US009740146B2

(12) United States Patent
Ohta

(10) Patent No.: US 9,740,146 B2
(45) Date of Patent: Aug. 22, 2017

(54) IMAGE FORMING APPARATUS WITH UPDATES FOR SPEED-BASED SETTING OF TRANSFER VOLTAGE

(71) Applicant: CANON KABUSHIKI KAISHA, Tokyo (JP)

(72) Inventor: Tetsuya Ohta, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/996,292

(22) Filed: Jan. 15, 2016

(65) Prior Publication Data

US 2016/0209792 A1 Jul. 21, 2016

(30) Foreign Application Priority Data

Jan. 16, 2015 (JP) ..... 2015-007278

(51) Int. Cl.
*G03G 15/16* (2006.01)
*G03G 15/00* (2006.01)

(52) U.S. Cl.
CPC ..... *G03G 15/1675* (2013.01); *G03G 15/1605* (2013.01); *G03G 15/5029* (2013.01)

(58) Field of Classification Search
CPC ..... G03G 15/50; G03G 15/5029; G03G 15/0189; G03G 15/1605; G03G 15/1665; G03G 15/1675; G03G 2215/00075; G03G 2215/00084
See application file for complete search history.

(56) References Cited

U.S. PATENT DOCUMENTS 4,110,031 A * 8/1978 Ebi ..... G03G 15/1675 399/167
6,804,481 B2 10/2004 Mochizuki et al.
2014/0255050 A1* 9/2014 Yoshida ..... G03G 15/1675 399/46

FOREIGN PATENT DOCUMENTS

EP 1355203 A2 10/2003
JP 2001125338 A 5/2001
JP 2003307948 10/2003

OTHER PUBLICATIONS

U.S. Appl. No. 14/976,313, Tetsuya Ohta, filed Dec. 21, 2015.

* cited by examiner

*Primary Examiner* — David M Gray
*Assistant Examiner* — Laura Roth
(74) *Attorney, Agent, or Firm* — Fitzpatrick, Cella, Harper & Scinto

(57) ABSTRACT

An image forming apparatus includes an image bearing member, a transfer member, a voltage source, a speed setting portion, a test mode executing portion, a renewing mode executing portion, and a setting portion for setting a voltage applied to the transfer member. In a period in which the toner image exists at the transfer portion when image formation is executed at a first speed, the setting portion sets the voltage applied to the transfer member at a first target voltage last renewed. In a period in which the toner image exists at the transfer portion when the image formation is executed at a second speed, the setting portion sets the voltage applied to the transfer member at a voltage on the basis of the first target voltage last renewed and a conversion coefficient last renewed.

8 Claims, 8 Drawing Sheets

IMAGE FORMING APPARATUS WITH UPDATES FOR SPEED-BASED SETTING OF TRANSFER VOLTAGE

FIELD OF THE INVENTION AND RELATED ART

The present invention relates to an image forming apparatus, such as a printer, a copying machine or a facsimile machine, for forming a character image, a graphic image or the like using a toner.

An image forming apparatus in which a toner image formed on a photosensitive drum is primary-transferred onto an intermediary transfer belt and then the toner image transferred on the intermediary transfer belt is secondary-transferred onto the recording material has been widely used. In the image forming apparatus using the intermediary transfer belt, voltage setting control is executed at a predetermined, so that a transfer voltage applied to a transfer member when the toner image is transferred from the photosensitive drum onto the intermediary transfer belt is set (Japanese Laid-Open Patent Application (JP-A) 2001-125338).

In JP-A 2001-125338, an image forming apparatus in which a rotational speed of each of the photosensitive drum and the intermediary transfer belt can be switched to two levels has been put into practical use. In this image forming apparatus, a voltage setting operation is executed at the two levels of the rotational speed every at a predetermined, so that a transfer voltage at each of the two levels of the rotational speed is set.

A proper transfer voltage largely changes with accumulation of the number of sheets subjected to image formation. For this reason, in order to maintain the proper transfer voltage, there is a need to execute the voltage setting operation at a high frequency. However, in the case where the voltage setting operation is executed at the high frequency in the image forming apparatus operable at different rotational speeds, when the voltage setting operation is executed every time at the different rotational speeds, downtime of the image forming apparatus undesirably increases.

SUMMARY OF THE INVENTION

According to an aspect of the present invention, there is provided an image forming apparatus comprising: an image bearing member for bearing a toner image; a transfer member for forming a transfer portion where the toner image is transferred from the image bearing member onto an intermediary transfer member; a voltage source for applying a voltage to the transfer member; a speed setting portion for setting a speed of the image bearing member at either one of speeds including a first speed and a second speed different from the first speed; a test mode executing portion for executing an operation in a test mode in which the speed of the image bearing member is set at a predetermined speed and a target voltage at which a predetermined target current corresponding to the predetermined speed is obtained from a relationship between a voltage and a current when the voltage is applied to the transfer member in a period in which the toner image does not exist at the transfer portion; a renewing mode executing portion for executing an operation in a voltage renewing mode in which a first target voltage is obtained by executing the operation in the test mode at the first speed and then is renewed and for executing an operation in a conversion coefficient renewing mode in which a second target voltage is obtained by executing the operation in the test mode at the second speed and a conversion coefficient is obtained from the first target voltage renewed in an immediately preceding voltage renewing mode and the second target voltage and then is renewed, wherein the renewing mode executing portion executes the operation in the voltage renewing mode at a frequency higher than a frequency of the operation in the conversion coefficient renewing mode; and a setting portion for setting a voltage applied to the transfer member, in a period in which the toner image exists at the transfer portion when image formation is executed at the first speed, at the first target voltage renewed in an immediately preceding voltage renewing mode and for setting the voltage applied to the transfer member, in a period in which the toner image exists at the transfer portion when the image formation is executed at the second speed, at a voltage on the basis of the first target voltage renewed in an immediately preceding voltage renewing mode and the conversion coefficient renewed in an immediately preceding coefficient renewing mode.

Further features of the present invention will become apparent from the following description of exemplary embodiments with reference to the attached drawings.

DESCRIPTION OF THE PREFERRED EMBODIMENTS

Hereinbelow, embodiments of the present invention will be described in detail with reference to the drawings.

Embodiment 1

<Image Forming Apparatus>

Figure 1:
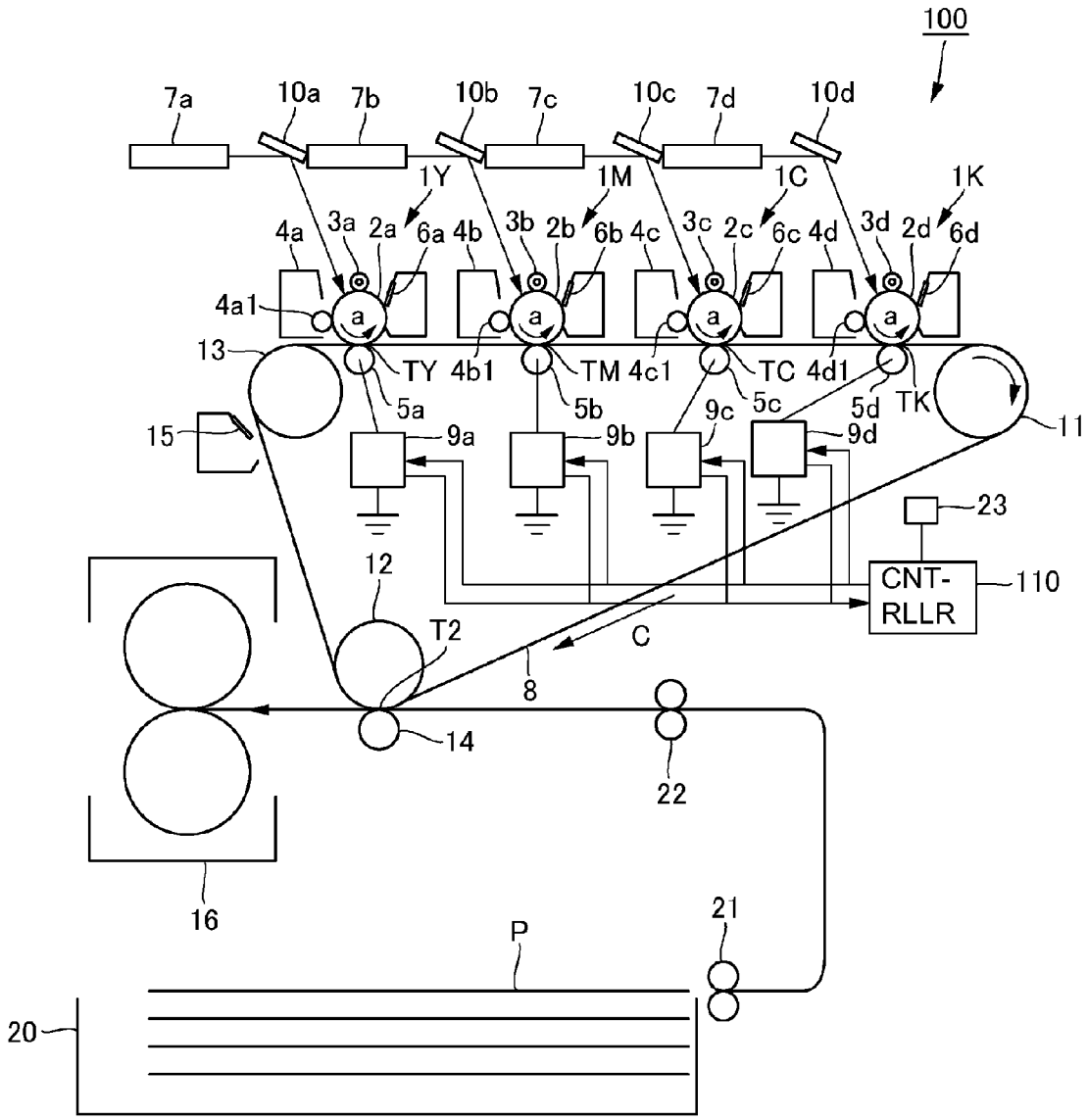
FIG. 1 is an illustration of a structure of an image forming apparatus.

FIG. 1 is an illustration of a structure of an image forming apparatus. As shown in FIG. 1, an image forming apparatus 100 in this embodiment is a tandem and intermediary transfer type full-color printer in which image forming portions 1Y, 1M, 1C and 1K are arranged along an upper surface of an intermediary transfer belt 8.

At the image forming portion 1Y, a yellow toner image is formed on a photosensitive drum 2*a* and then is primary-transferred onto the intermediary transfer belt 8. At the image forming portion 1M, a magenta toner image is formed on a photosensitive drum 2*b* and is primary-transferred onto the intermediary transfer belt 8. At the image forming portions 1C and 1K, a cyan toner image and a black toner image are formed on photosensitive drums 2*c* and 2*d*, respectively, and are successively primary-transferred onto the intermediary transfer belt 8.

The four color toner images transferred on the intermediary transfer belt 8 are conveyed to a secondary transfer portion T2 and then are secondary-transferred onto a recording material P. A separation roller 21 separates the recording material P, one by one, pulled out from a recording material cassette 20 and then sends the recording material P to a registration roller pair 22. The registration roller pair 22 sends the recording material P to a secondary transfer portion T2 by timing the recording material P to the toner images on the intermediary transfer belt 8.

The recording material P on which the four color toner images are transferred is heated and pressed by a fixing device 16, so that the toner images are fixed on the surface of the recording material P. Thereafter, the recording material P is discharged onto a discharge tray by an unshown discharging roller.

The image forming portions 1Y, 1M, 1C and 1K have the substantially same constitution except that the colors of toners of yellow, cyan, magenta and black used in developing devices 4*a*, 4*b*, 4*c* and 4*d* are different from each other. In the following description, the image forming portion 1Y for yellow will be described and other image forming portions 1M, 1C and 1K will be omitted from redundant description.

The image forming portions 1Y includes the photosensitive drum 2*a*. Around the photosensitive drum 2*a*, a charging roller 3*a*, an exposure device 7, the developing device 4*a*, a primary transfer roller 5*a*, and a drum cleaning device 6*a* are disposed. The photosensitive drum 2*a* is constituted by an aluminum cylinder of 30 mm in outer diameter on which a photosensitive layer of an organic photosemiconductor (OPC) is formed, and is rotated at a predetermined process speed.

To the charging roller 3*a*, an oscillating voltage in the form of a negative DC voltage biased with an AC voltage is applied, so that the surface of the photosensitive drum 2*a* is electrically charged to a uniform negative potential (−600 V). The surface of the photosensitive drum 2*a* is scanned by exposure device 7 with a laser beam obtained by subjecting a scanning line image signal developed from yellow image data to ON-OFF modulation through a rotating mirror, so that an electrostatic image is formed (written) on the surface of the photosensitive drum 2*a*. The developing device 4*a* moves the toner to the photosensitive drum 2*a*, so that the electrostatic image is developed into the toner image.

To transfer roller 5*a* transfers the toner image carried on the photosensitive drum 2*a* onto the intermediary transfer belt 8. The drum cleaning device 6*a* causes its cleaning blade to rub the photosensitive drum 2*a* to remove the transfer residual toner deposited on the surface of the photosensitive drum 2*a*.

A secondary transfer outer roller 14 contacts the intermediary transfer belt 8 supported by a secondary transfer inner roller 12 at an inner peripheral surface of the intermediary transfer belt 8, thus forming the secondary transfer portion T2. By applying a positive DC voltage to the secondary transfer outer roller 14, the toner image on the intermediary transfer belt 8 is secondary-transferred onto the recording material P. A belt cleaning device 15 rubs the intermediary transfer belt 8 with the cleaning blade, thus collecting the transfer residual toner on the surface of the intermediary transfer belt 8.

(Intermediary Transfer Belt)

The intermediary transfer belt 8 is extended around and supported by a tension roller 13, the secondary transfer inner roller 12 and a driving roller 11, and is driven by the driving roller 11, so that the intermediary transfer belt 8 is rotated in an arrow C direction at the same speed as the speed of the photosensitive drum 2*a*. The driving roller 11 includes a metal shaft and an electroconductive rubber layer formed on an outer peripheral surface of the metal shaft. A resistance value of the electroconductive rubber layer is adjusted to $1\times10^3$-$1\times10^5\Omega$, and the shaft is connected to the ground potential.

The intermediary transfer belt 8 includes an 85 μm-thick polyimide resin film as a base material in which carbon black is dispersed, thus being resistance-adjusted so as to have a surface resistivity of $1\times10^{12}$ Ω/square and a volume resistivity of $1\times10^9$ Ω·cm.

(Primary Transfer Portion)

The primary transfer roller 5*a* is disposed at a predetermined, opposing the photosensitive drum 2*a*, at an inner peripheral surface of the intermediary transfer belt 8. The transfer roller 5 sandwiches the intermediary transfer belt 8 between itself and the photosensitive drum 2*a* and forms a primary transfer portion TY of the toner image between the photosensitive drum 2*a* and the intermediary transfer belt 8. A voltage source 9*a* applies a positive DC voltage to the transfer roller 5, so that a negative toner image carried on the photosensitive drum 2*a* is transferred onto the intermediary transfer belt 8.

The primary transfer roller 5*a* is prepared by forming a 1.0 mm-thick elastic layer of an electroconductive foam rubber material on a peripheral surface of a shaft, formed of an electroconductive metal, having a diameter of 8 mm. The rubber material is EPDM (ethylene-propylene-dien terpolymer). The volume resistivity of the rubber material is $5.0\times10^6$ Ω/cm at 20° C. in a state in which an ion-conductive agent is dispersed. A weight of the primary transfer roller 5*a* is 300 g. The primary transfer roller 5*a* is urged upward by urging springs provided at both end portions thereof at a total pressure of 10 N (1 kgf).

(Process Speed)

Figure 2:
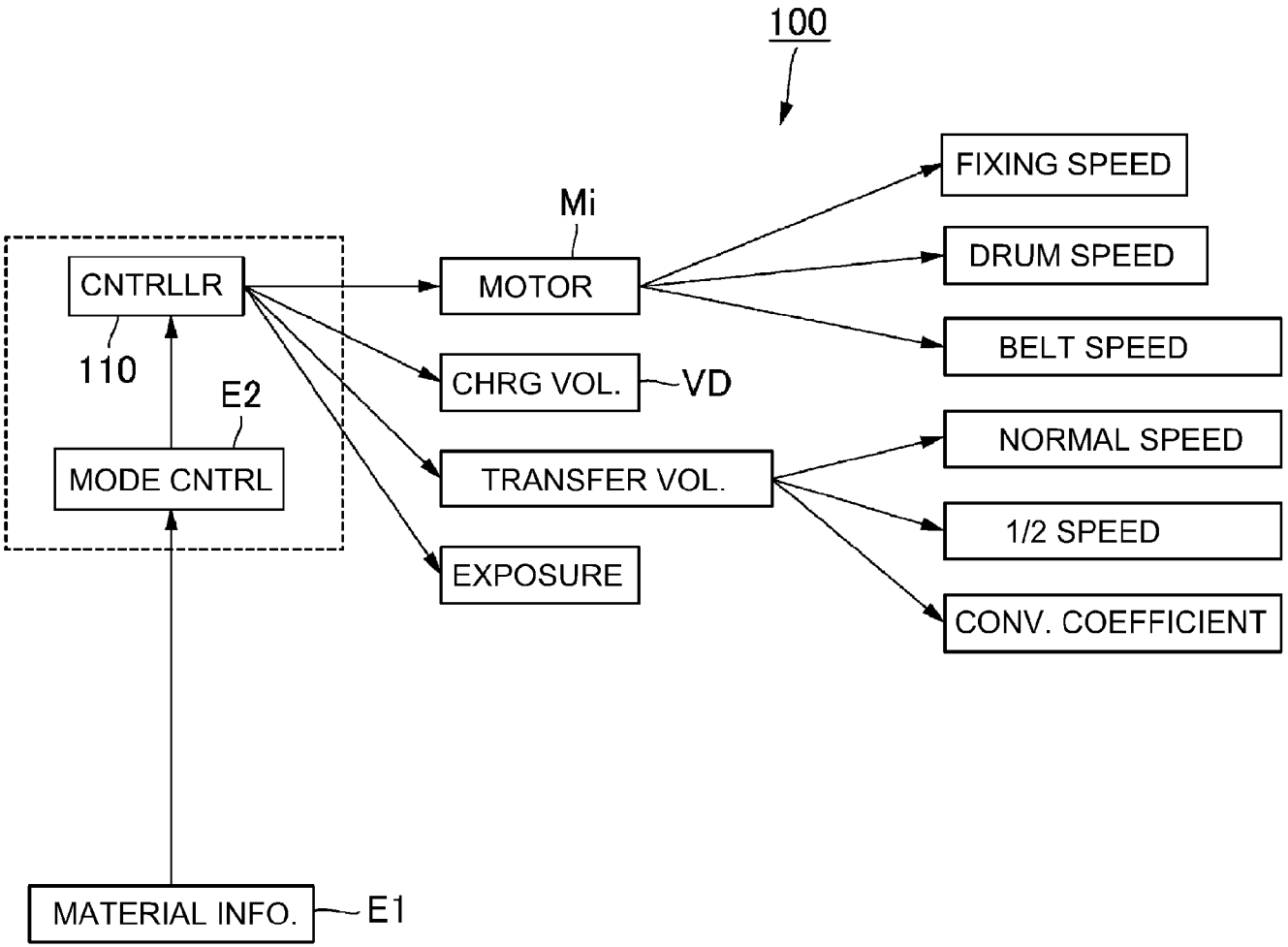
FIG. 2 is a block diagram of process speed change control.

FIG. 2 is a block diagram of process speed change coefficient.

As shown in FIG. 2, in the image forming apparatus 100, in order to meet diversification of users in recent years, speeds in a transfer step and a fixing step, i.e., a process speed is changed depending on a species of the recording material. In the image forming apparatus 100, a rotational speed of the intermediary transfer belt 8 in an operation in a standard speed mode is 200 mm/sec, and a peripheral speed of the photosensitive drum 2*a* is 200 mm/sec in the operation in the standard speed mode. In an operation in a ½ speed mode, the rotational speed of the intermediary transfer belt 8 is 100 mm/sec, and the peripheral speed of the photosensitive drum 2*a* is 100 mm/sec.

When job data including image formation of one or more sheet is received by a controller 110, the controller 110 obtains recording material designation information from the job data, and then selects a speed mode. The controller 110 selects the ½ speed mode when thick paper or an OHT sheet is used as a recording material P, and lowers the process speed in the operation of the standard speed mode (normal process speed), in which plain paper is used as the recording material P, to ½.

This is because in the case where the toner is transferred onto the thick paper at the secondary transfer portion T2, a transfer electric field formed at the secondary transfer portion T2 is small compared with the case of the plain paper and thus improper transfer is liable to generate. This is also because when the image is fixed by the fixing device 16, the thick paper has a large heat quantity necessary for fixing compared with the case of the plain paper and therefore improper fixing is liable to generate. For that reason, the controller 110 lowers the process speed to prolong a time in which the thick paper passes through the primary transfer portion T1 and the nip of the fixing device 16, so that the above problems are solved.

In the case where the process speed is changed, a rotational speed of a plurality of driving motors Mi is changed, so that a fixing speed, a photosensitive drum speed and an intermediary transfer belt speed are changed. With a change in process speed, also the charging voltage, the primary transfer voltage and the exposure condition are changed.

When a user sends a job data, in which the species of the recording material P is designated as the thick paper, to the image forming apparatus 100, the controller 110 discriminates that the speed mode is the ½ speed mode. Then, the controller 110 controls the driving motors Mi (i=1, 2, 3) for providing rotational forces to the fixing device 16, the driving roller 11 and the photosensitive drums 2 so that the process speed is ½ of the process speed in the standard speed mode.

As described above, the photosensitive drum 2*a* which is an example of an image bearing member rotates while carrying the toner image. The intermediary transfer belt 8 which is an example of an intermediary transfer member is constituted by an endless belt, and the toner image carried on the photosensitive drum 2*a* is transferred onto the intermediary transfer belt 8 at the primary transfer portion TY which is an example of a transfer portion, and thus the intermediary transfer belt 8 rotates. The primary transfer portion TY is formed by bringing the primary transfer roller 5*a* which is an example of a transfer roller into contact with the intermediary transfer belt 8 supported by the photosensitive drum 2*a*. The voltage source 9*a* which is an example of a voltage source applies a voltage to the primary transfer portion TY.

The motors and the controller 110 which are an example of a switching means are capable of changing the rotational speeds of the detect 2*a* and the intermediary transfer belt 8 to the standard speed which is an example of a first speed and a ½ speed which is an example of a second speed. The ½ speed is lower than the standard speed, and a frequency of image formation executed in a switched state to the ½ speed is lower than a frequency of image formation executed in a switched state to the standard speed.

(Voltage Setting Control)

Figure 3:
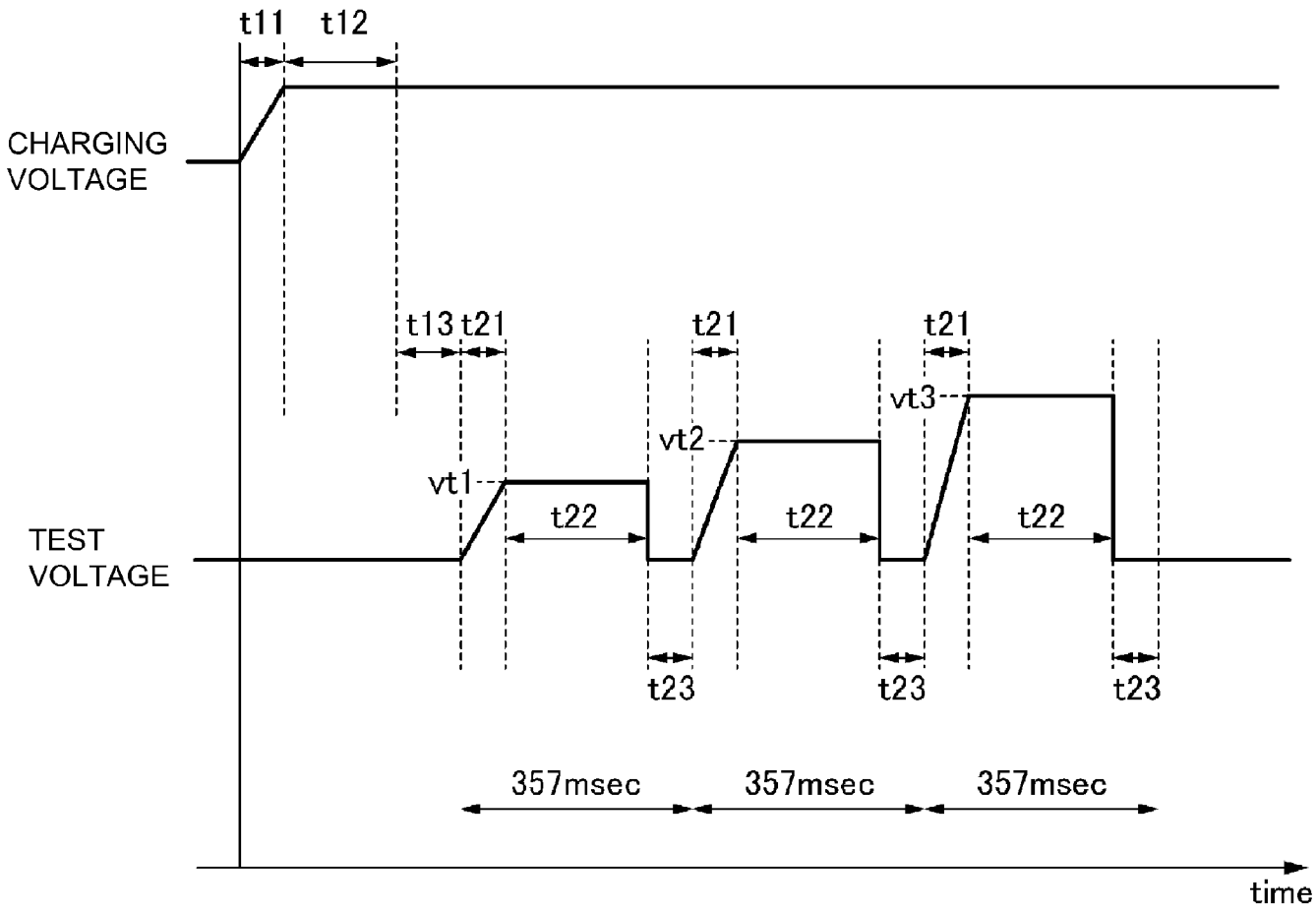
FIG. 3 is a timing chart of voltage setting control.
Figure 4:
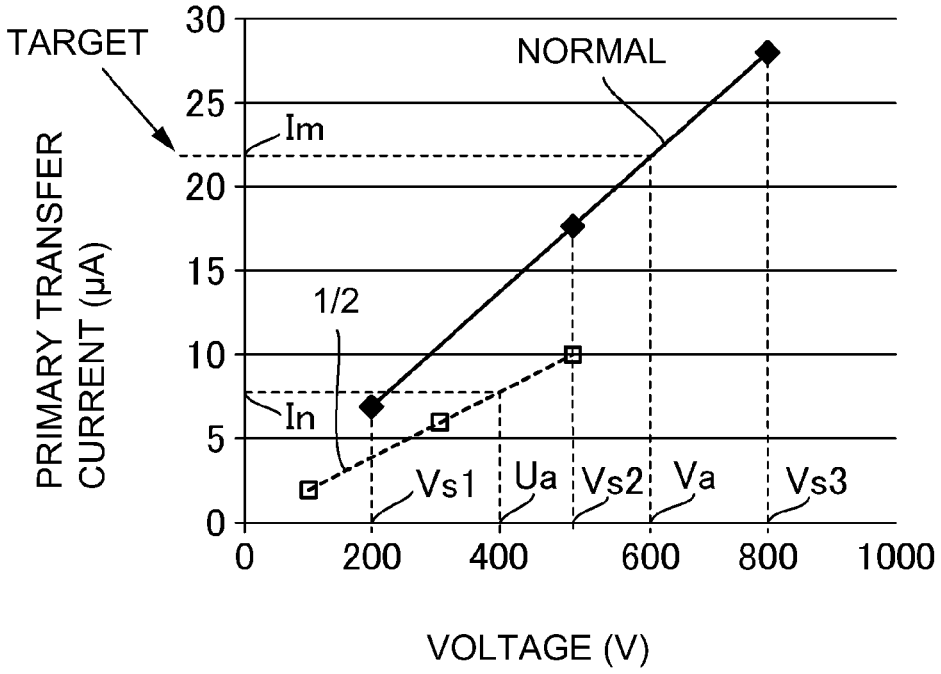
FIG. 4 is a graph showing a detection result of the voltage setting control.

FIG. 3 is a timing chart of voltage setting control. FIG. 4 is a graph showing a detection result of the voltage setting control. As shown in FIG. 1, a proper transfer voltage applied to the primary transfer roller 5*a* complicatedly changes depending on a resistance value of the primary transfer roller 5*a*, and a charge amount, a temperature and an absolute humidity of the toner at the primary transfer portion T1. For this reason, the controller 110 periodically executes the voltage setting control which is an example of a voltage setting means and thus empirically sets the transfer voltage again. The voltage setting control is executed at timing when the image formation is not effected.

The voltage setting control is executed at the image forming portions 1Y, 1M, 1C, 1K using the same sequence while somewhat shifting a time. For this reason, in this embodiment, the voltage setting control at the image forming portion 1Y will be described and the voltage setting control at other image forming portions 1M, 1C, 1K will be omitted from redundant description.

In the voltage setting control, the photosensitive drum 2*a* and the intermediary transfer belt 8 are rotated at the process speed in the operation in the standard speed mode. The voltage source 9*a* includes a detecting circuit for an output current, i.e., a detecting circuit or a current flowing through the primary transfer roller 5*a*. The controller 110 charges the photosensitive drum 2 to the same potential VD as the potential during normal image formation executed at the standard speed, and controls the voltage source 9*a*, so that as shown in FIG. 3, 3 species of test voltages (Vt1, Vt2, Vt3) different in voltage are successively applied to the primary transfer roller 5*a*. Then, at the 3 species of test voltages, currents (It1, It2, It3) flowing through the primary transfer roller 5*a* are detected.

The controller 110 induces a voltage-current relationship from a current detection result as shown in FIG. 4, and calculates a voltage at which a first target current determined as a peak of a transfer efficiency. The controller 110 uses the voltage as a primary transfer voltage V1*a* during the image formation. The controller 110 controls the voltage source 9*a* during the image formation and applies the primary transfer voltage V1*a* to the primary transfer roller 5*a* under constant voltage control.

As shown in FIG. 1, the voltage setting control in the operation in the standard speed mode is executed similarly at the image forming portions 1Y, 1M, 1C, 1K, so that primary transfer voltages obtained in last voltage setting control are replaced with newly obtained primary transfer voltages V1*a*, V1*b*, V1*c*, V1*d*. A voltage-current relationship obtained in the voltage setting control at the image forming portions TY, TM, TC, TK and the primary transfer voltages V1*a*, V1*b*, V1*c*, V1*d* are stored in a memory of the controller 110.

As shown in FIG. 4, in the voltage setting control, the test voltages are set so as to be Vt1=+200 V, Vt2=+500 V, Vt3=+800 V. In FIG. 4, the abscissa represents the primary transfer voltage, and the ordinate represents a primary transfer current. Each of plotted points represents a value of the test voltage and a value of a corresponding current. In the case where the test voltage not less than a certain voltage value is applied, it has been clarified that the voltage-current relationship can be approximated by a rectilinear line. For this reason, in FIG. 4, intervals between measuring points are approximated by rectilinear lines. In the voltage setting control, voltage-current measuring points are subjected to linear approximation, and thereafter the voltage value V1*a* providing a predetermined target current value on an approximated line is obtained by computation, and is set as the primary transfer voltage V1*a* during the image formation.

As shown in FIG. 3, when the voltage setting control is started, the charging voltage is applied to the charging roller 3, so that the photosensitive drum 2 is charged to −600 V which is the same as the voltage during normal image formation. After the charging voltage is applied, after a lapse of times T11+T12+T13, a first test voltage (Vt1) is applied to the primary transfer roller 5. The time t11 is a time until the DC voltage of the oscillating voltage applied to the charging roller 3*a* reaches the charging voltage VD and is 100 msec. The time t12 is a time in which the detect 2*a* is rotated one full turn in a state in which the charging voltage is applied to the charging roller in order to stable charge the photosensitive drum 2*a* to a desired potential (−600 V in this embodiment) and is 471 msec. The time t13 is a time required for moving a region of the photosensitive drum 2*a* charged by the charging roller 3*a* to the primary transfer portion T1 and is 236 msec.

After a lapse of a time t21 in which an output of the voltage source 9*a* reaches the first test voltage Vt1, a current flowing through the transfer roller 5*a* is detected. The current detection is made during a time t22 in which the transfer roller 5*a* rotates one full turn. When the current detection for the first test voltage is ended, obtained data is processed (t23). The time t21 is 100 msec, the time t22 is 157 msec, and the time t23 is 100 msec.

Subsequently, in a similar manner, the current detection of the second test voltage (Vt2) and data processing are effected, and finally the current detection of the third test voltage (Vt3) and data processing are effected.

As described above, the controller 110 controls the voltage source 9*a* and executes the voltage setting control. In the voltage setting control, a target voltage at which a predetermined target current flows is set from a voltage-current relationship when the voltage of the voltage source 9*a* is applied to the primary transfer portion TY. In the voltage setting control, a constant voltage is outputted from the voltage source 9*a* and a current flowing through the primary transfer portion TY is detected, so that a target voltage of the transfer voltage applied from the voltage source 9*a* to the primary transfer roller 5*a* is set on the basis of a relationship between the outputted constant voltage and the detected current.

(Transfer Voltage in ½ Speed Mode)

As shown in FIG. 4, in the case where the image formation is executed by the operation in the ½ speed mode, compared with the case where the image formation is executed by the operation in the standard speed mode a charge supply amount from the primary transfer roller 5*a* to the photosensitive drum 2*a* decreases to ½ thereof, and therefore there is a need to set a transfer voltage lower than the transfer voltage in the operation in the standard speed mode. This is because in the ½ speed mode, compared with the standard speed mode, an amount per unit time of the toner moving from the photosensitive drum 2*a* to the intermediary transfer belt 8 becomes ½ thereof. When the process speed becomes slow, an area of the photosensitive drum 2*a* passing through the primary transfer portion TY for 1 sec becomes small, so that a moved charge amount per unit time becomes small.

Comparison Example

As a method for setting the transfer voltage in the operation in the ½ speed mode, it would be considered that the same voltage setting control as the voltage setting control in the operation in the standard speed mode described above is executed at the time of actuation of the image forming apparatus or at an interval for each of the image formation of a predetermined print number. For example, as described in JP-A 2001-125338, subsequently to the voltage setting control in the operation in the standard speed mode, the process speed is lowered to ½ thereof, and then coefficient setting control is executed. In this case, a total time of the coefficient setting control becomes long, so that downtime of the image forming apparatus 100 increases. Particularly, when the voltage setting control is executed in the operation in the ½ speed mode, a peripheral speed of the photosensitive drum 2*a* becomes ½ of the peripheral speed of the photosensitive drum 2*a* in the operation in the standard speed mode, and therefore a time required for the test voltage application (current detection) becomes twice that in the operation in the standard speed mode, so that the downtime of the image forming apparatus 100 further increases.

In order to solve the problem, in the image forming apparatus 100, only the voltage setting control in the operation in the standard speed mode is periodically executed, so that the transfer voltage in the operation in the standard speed mode is renewed. When the image formation is executed in the operation in the ½ speed mode, the transfer voltage in the operation in the ½ speed mode is set by multiplying the transfer voltage in the operation in the standard speed mode by a conversion coefficient which is an example of a correspondence relationship. As a result, the downtime due to the voltage setting control in the operation in the ½ speed mode is reduced.

However, in the case where the conversion coefficient is not renewed, an improper transfer voltage is calculated due to a resistance fluctuation of the primary transfer roller 5*a* resulting from a temperature change, accumulation of the image formation or the like in some cases. When unintended resistance fluctuation generates on the primary transfer roller 5*a*, at a transfer voltage obtained by multiplying the transfer voltage in the operation in the standard speed mode by the conversion coefficient, a second target current determined as a peak of the transfer efficiency cannot be caused to flow through the primary transfer roller 5*a*. As a result, the transfer efficiency lowers and the amount of the transfer residual toner increases, so that a lowering in image density, misregistration of color hue and a lowering in color saturation are caused and thus an image quality of an output image lowers.

In the case where the voltage setting control in the operation in the standard speed mode and the voltage setting control in the operation in the ½ speed mode are independently executed, a total time required for the transfer voltage setting becomes long. In the case where the transfer voltage in the operation in the ½ speed mode is set by multiplying the transfer voltage obtained in the voltage setting control in the operation in the standard speed mode by a fixed conversion coefficient value, the time required for setting the transfer voltage is short, but there is a possibility that an improper transfer voltage is set due to the resistance fluctuation of the primary transfer roller 5*a*.

Therefore, in Embodiment 1, in the case where the image formation in the operation in the ½ speed mode is effected, the transfer voltage obtained in the last voltage setting control is multiplied by the conversion coefficient, so that the transfer voltage in the operation in the ½ speed mode is set. However, the conversion coefficient is not fixed value, but is newly set by executing the coefficient setting control at timing when a possibility that the resistance fluctuation of primary transfer roller 5*a* generates increases.

Then, an execution frequency (every 1000 sheets) of the coefficient setting control is made lower than an execution frequency (every 200 sheets) of the voltage setting control, so that the number of times of control relating to setting of the transfer voltage is reduced without lowering a frequency of renewal of the transfer voltage. A threshold (absolute humidity: 9 g/m$^3$) of an environment fluctuation during execution of last voltage setting control in the case of the operation in the ½ speed mode is alleviated compared with a threshold (absolute humidity: 6 g/m$^3$) of the case of the operation in the standard speed mode, so that the number of times of control relating to setting of the transfer voltage is reduced.

(Voltage Setting Control)

Figure 5:
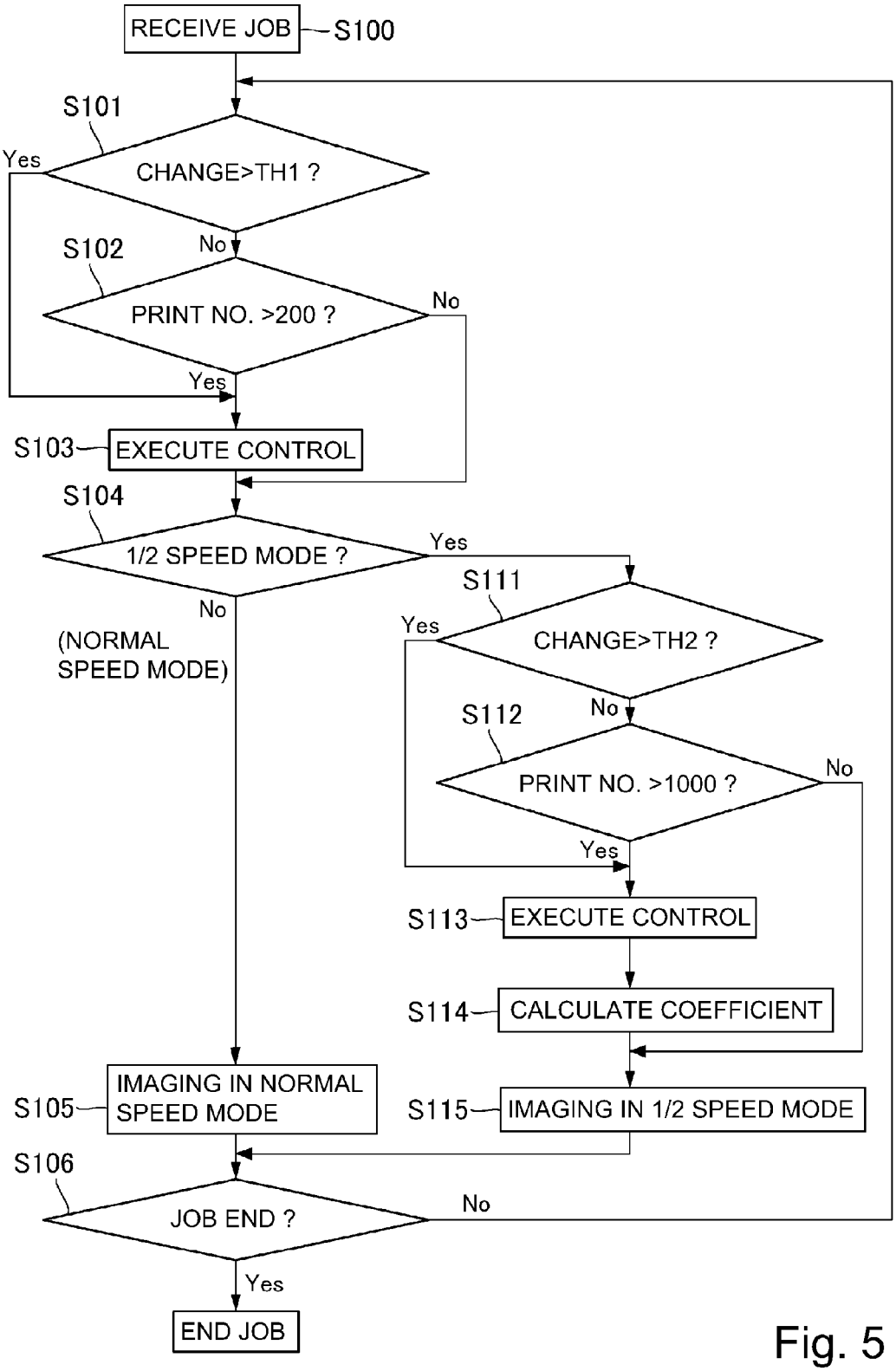
FIG. 5 is a flowchart of setting control of a primary transfer voltage.
Figure 6:
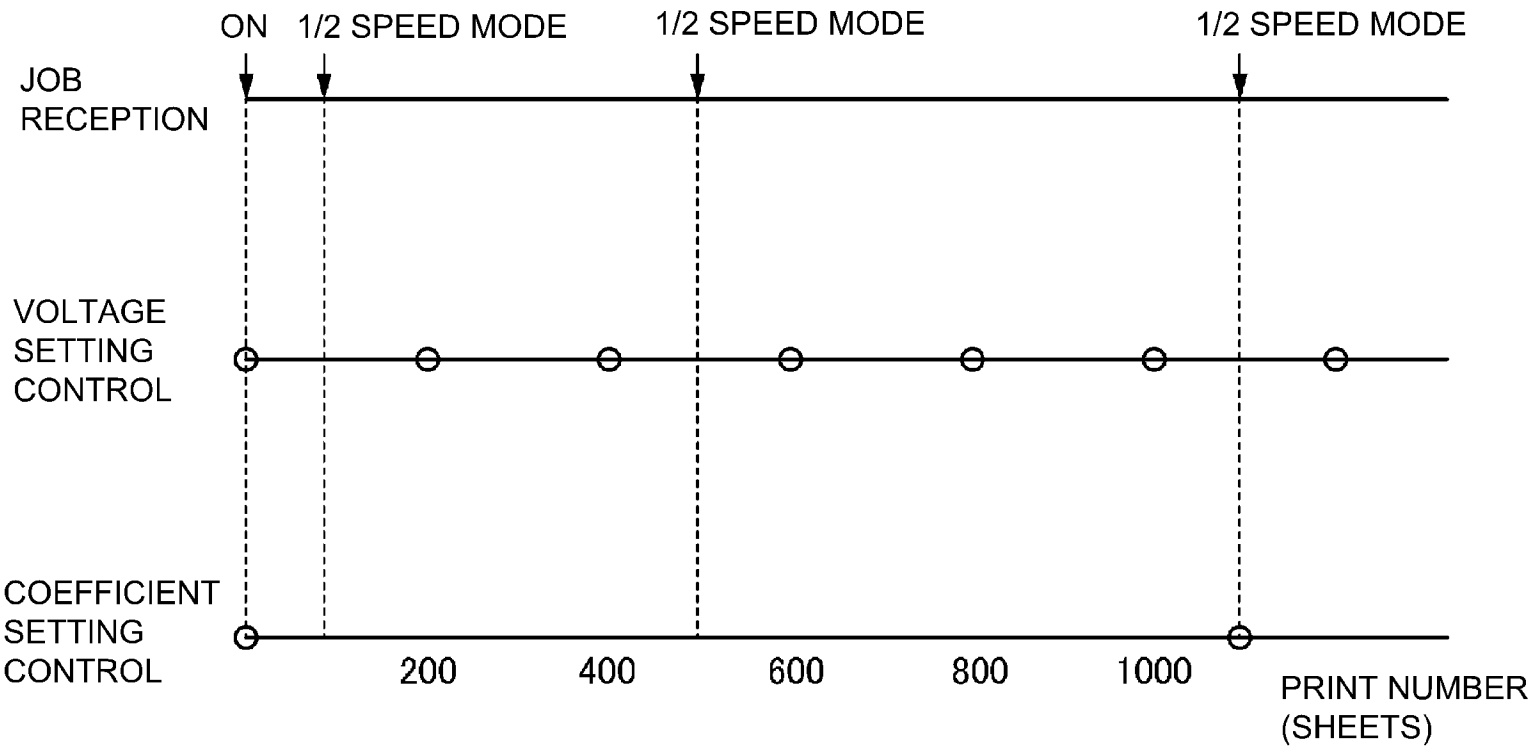
FIG. 6 is an illustration of an execution frequency of the voltage setting control.

FIG. 5 is a flowchart of primary transfer voltage setting control in Embodiment 1. FIG. 6 is an illustration of an execution frequency of each of the voltage setting control and the coefficient setting control. As shown in FIG. 1, the controller 110 receives job data and executes image formation on a recording material designated by the job data, so that conversion into A4 size (long edge feeding) is made and the number of cumulative sheets subjected to the image formation is counted. A temperature and humidity sensor 23 which is an example of a detecting portion and the controller 110 detect an ambient temperature and an ambient absolute humidity.

As shown in FIG. 5, when the controller 110 receives the job data (S100), the controller 110 discriminates whether or not an environment (ambient absolute humidity (g/m$^3$) exceeds a threshold 1 (absolute humidity: 6 g/m$^3$) from the execution of the last voltage setting control (S101). In the case where the environment exceeds the threshold 1 (Yes of S101), the controller 110 executes the voltage setting control at the image forming portions 1Y, 1M, 1C, 1K (S103), so that the primary transfer voltages V1*a*, V1*b*, V1*c*, V1*d* are set again (S103).

In the case where the environment does not exceed the threshold 1 (No of S101), the controller 110 discriminates whether or not a cumulative value of a total print number of sheets subjected to the operation in the standard speed mode and the operation in the ½ speed mode after the last voltage setting control reaches 200 sheets (S102).

In the case where the cumulative value exceeds 200 sheets (Yes of S102), the controller 110 executes the voltage setting control at the image forming portions 1Y, 1M, 1C, 1K (S103), so that the primary transfer voltages V1*a*, V1*b*, V1*c*, V1*d* are set (S103).

The controller 110 discriminates whether or not subsequent image formation is effected in the operation in the ½ speed mode (S104). In the case where the image formation is not effected in the ½ speed mode (No of S104), the image formation is effected in the operation in the standard speed mode without executing the coefficient setting control (S105). In the image formation, the primary transfer voltages V1*a*, V1*b*, V1*c*, V1*d* obtained in the last voltage setting control are applied to the primary transfer rollers 5*a*, 5*b*, 5*c*, 5*d*, respectively, so that the primary transfer of the toner images for images is executed. When the image formation for the job is ended (Yes of S106), the job is ended.

In the case of the operation in the ½ speed mode (Yes of S104), the controller 110 discriminates whether or not an environment (ambient absolute humidity (g/m$^3$) exceeds a threshold 2 (absolute humidity: 9 g/m$^3$) from control during the execution of the last coefficient setting control (S111).

In the case where the environment exceeds the threshold 2 (Yes of S111), the controller 110 executes the coefficient setting control at the image forming portions 1Y, 1M, 1C, 1K (S113), so that conversion coefficient values at the primary transfer portions TY, TM, TC, TK are set (S114).

In the case where the environment does not exceed the threshold 2 (No of S111), the controller 110 discriminates whether or not a cumulative value of a total print number of sheets subjected to the operation in the standard speed mode and the operation in the ½ speed mode after the last coefficient setting control reaches 1000 sheets (S112).

In the case where the cumulative value does not exceed 1000 sheets (No of S112), the controller 110 executes the image formation in the operation in the ½ speed mode without executing the coefficient setting control (S115). In the image formation in the operation in the ½ speed mode, the primary transfer voltages V1*a*, V1*b*, V1*c*, V1*d* obtained in the last voltage setting control is multiplied by the conversion coefficient values stored in the memory of the controller 110, so that the primary transfer voltages V1*a*, V1*b*, V1*c*, V1*d* are set. In the memory of the controller 110, the conversion coefficient values at the primary transfer portions TY, TM, TC, TK obtained in the last coefficient setting control are stored. When the image formation for the job is ended (Yes of S106), the job is ended.

In the case where the cumulative value exceeds 1000 sheets (Yes of S112), the controller 110 executes the coefficient setting control at the image forming portions 1Y, 1M, 10, 1K (S113), so that the conversion coefficient values at the primary transfer portions TY, TM, TC, TK are set (S114). That is, the constant voltage is outputted from the voltage source 9*a* and a current flowing through the primary transfer roller 5*a* is detected, and on the basis of a relationship between the outputted constant voltage and the detected current, the transfer voltage in the operation in the ½ speed mode is obtained so as to cause a second target current to flow. A new conversion coefficient is obtained by dividing the transfer voltage in the operation in the ½ speed mode by the transfer voltage in the operation in the standard speed mode obtained in the last voltage setting control.

The controller 110 executes the image formation in the operation in the ½ speed mode (S115). In the image formation in the operation in the ½ speed mode, the primary transfer voltages V1*a*, V1*b*, V1*c*, V1*d* obtained in the last voltage setting control is multiplied by the latest conversion coefficient values stored in the memory of the controller 110, so that the primary transfer voltages V1*a*, V1*b*, V1*c*, V1*d* are set.

In this way, until the job is ended (No of S106), the image formation is executed (S101-S105, S111-S115), and when the job is ended (Yes of S106), the job is ended.

As shown in FIG. 6, in the case where the environment fluctuation does not generate, the coefficient setting control is executed in advance of the image formation in the predetermined in the ½ speed mode executed first after cumulative image formation of 1000 sheets is effected after last execution of the operation in the standard speed mode.

As described above, the controller 110 executes the voltage setting control in a switched state to the standard speed for each of image formation of 200 sheets which is an example of a first predetermined print number or a first predetermined time, and sets the target voltage at the standard speed. The controller 110 executes the voltage setting control in a switched state to the ½ speed after image formation of 1000 sheets which is an example of a second predetermined print number larger than the first predetermined print number or a second predetermined time longer than the first predetermined time, and sets the target voltage at the ½ speed. For this reason, the execution frequency of the coefficient setting control is not more than ⅕ of the execution frequency in the standard speed mode.

The controller 110 executes an operation in a first setting mode after a change amount of the detected temperature exceeds a predetermined amount or after a change amount of the detected absolute humidity exceeds a predetermined amount, and executes the voltage setting control in the switched state to the ½ speed, so that the target voltage at the ½ speed is set. For this reason, it is possible to cancel also an error in conversion coefficient with an unexpected temperature change or absolute humidity change generating at an interval of 1000 sheets.

However, in either case, the controller 110 first executes the operation in the first setting mode when the image formation is effected in the switched state to the ½ speed, and executes the voltage setting control in the switched state to the ½ speed, so that the target voltage is set. The controller 110 sets the conversion coefficient only when the target voltage at the ½ speed is set in the voltage setting control. For this reason, the number of times of the voltage setting control in the operation in the ½ speed mode requiring much time can be minimized.

(Coefficient Setting Control)

As shown in FIG. 4, in the coefficient setting control, an operation in a detecting mode is executed at the image forming portion 1Y, so that a voltage-current relationship at the primary transfer portion TY is obtained. In the coefficient setting control, the test voltages were set so as to Vt1=+100 V, Vt2=+300 V and Vt3=+500 V.

Then, from the voltage-current relationship and a target current value In in the operation in the ½ speed mode, a primary transfer voltage Va at the image forming portion 1Y is determined. Also at the image forming portions 1M, 1C, 1K, a similar procedure is executed, so that primary transfer voltages Vb, Vc, Vd are determined.

Then, conversion coefficients λa, λb, λc, λd which are ratios between the primary transfer voltages Va, Vb, Vc, Vd at the standard speed and the primary transfer voltages Va, Vb, Vc, Vd at the ½ speed are obtained from the following formula.

$$\lambda i = Ui/Vi (i: a, b, c, d)$$

In the image formation in the operation in the ½ speed mode, using the thus-obtained conversion coefficients λa, λb, λc, λd, primary transfer voltages U'a, U'b, U'c, U'd in the operation in the ½ speed mode at the image forming portions 1Y, 1M, 1C, 1K are calculated. The primary transfer voltages U'a, U'b, U'c, U'd are determined by the following formula.

$$U'i = \lambda i \times Vi (i: a, b, c, d)$$

Then, the voltage-current relationships for the respective colors, the conversion coefficient λa, λb, λc, λd and the primary transfer voltages U'a, U'b, U'c, U'd in the operation in the ½ speed mode which are obtained in the coefficient setting control are stored in the memory provided in the controller 110. Then, in the image formation in the operation in the ½ speed mode, using the primary transfer voltages U'a, U'b, U'c, U'd in the operation in the ½ speed mode determined as described above, the image formation in the operation in the ½ speed mode is carried out.

As shown in FIG. 6, in Embodiment 1, at the time of start of use (at the time of main assembly installation) when the image forming apparatus 100 has not been used until now and a main switch is first turned on, the conversion coefficients λa, λb, λc, λd, have not been determined as yet. For this reason, when the image formation in the operation in the ½ speed mode is first effected, the voltage setting control is executed irrespective of the steps S101, S102 in the flowchart of FIG. 5, and then the coefficient setting control is executed irrespective of the steps S111, S112.

In the case where during the continuous image forming job, the environment fluctuation from execution of the last voltage setting control exceeds a predetermined allowable range (Yes of S101), the job is temporarily interrupted and the voltage setting control is executed, so that the primary transfer voltage at the standard speed is changed. In the case where during the continuous job, the environment fluctuation from the execution of the last coefficient setting control exceeds a predetermined allowable range (Yes of S111), the job is temporarily interrupted and the coefficient setting control is executed, so that the conversion coefficient is changed.

As described above, the controller 110 which is an example of an executing portion executes the coefficient setting control and sets the target voltage at the ½ speed using the conversion coefficient.

The controller 110 sets the target voltage at the first speed by executing the voltage setting control in the switched state to the standard speed, and sets the target voltage at the second speed by executing the voltage setting control in the switched state to the ½ speed. Then, the controller 110 set the conversion coefficient as the correspondence relationship between the target voltage at the standard speed and the target voltage at the ½ speed.

(Impedance at Primary Transfer Portion)

As shown in FIG. 4, in the case of the operation in the ½ speed mode ("½"), compared with the operation in the standard speed mode ("NORMAL"), a slope of a voltage-current rectilinear line is moderate. That is, in the case of the ½ speed mode, compared with the case of the standard speed mode, an impedance at the primary transfer portion TY becomes large.

A charge movement amount onto the photosensitive drum 2*a* by the transfer voltage corresponds to electric charges in an amount required for changing the potential, in a region where the photosensitive drum 2*a* passes through the primary transfer portion TY in 1 sec, from the changing potential VD to a charge movement end potential. When the process speed becomes slow, an area of the photosensitive drum 2*a* passing through the primary transfer portion TY in 1 sec decreases, and therefore also a moved charge amount per unit time decreases.

On the other hand, a voltage necessary when a predetermined current is caused to flow through the primary transfer roller 5*a* does not change depending on the process speed. For these two reasons, the impedance at the primary transfer portion TY where the target voltage is applied during the operation in the ½ speed mode is higher than the impedance at the primary transfer portion TY where the target voltage is applied during the operation in the standard speed mode. In the case where the impedance at the primary transfer portion TY increase, at the original conversion coefficient, a desired target current cannot be caused to pass through the primary transfer roller 5*a*.

Effect of Embodiment 1

In Embodiment 1, the primary transfer voltage in the operation in the ½ speed is determined using the conversion coefficient obtained in the coefficient setting control and the primary transfer voltage in the operation in the standard speed mode obtained in the voltage setting control, and therefore the execution frequency of the coefficient setting control is low. In the image forming apparatus 100 in which the image formation is effected at the plurality of process speeds and the transfer voltage is set, a time required to set the primary transfer voltage can be shortened.

In Embodiment 1, even when the environment fluctuation threshold is alleviated, primary transfer current accuracy can be maintained by making reference to a result of the voltage setting control effected at a high frequency.

In Embodiment 1, the frequency at which the operation in the detecting mode in the coefficient setting control is lower than the frequency at which the operation in the detecting mode in the voltage setting control. For this reason, even when the coefficient setting control is not executed, the transfer voltage used for the image formation effected at the ½ speed can be renewed by the frequency of the voltage setting control.

In Embodiment 1, the execution frequency of the image formation in the operation in the ½ speed mode is lower than the execution frequency of the image formation in the operation in the standard speed mode. For this reason, the number of times of operations in a coefficient conversion mode executed at the ½ speed is small. The voltage setting control on the basis of an actually measured value may only be required to be effected only in the operation in the standard speed mode performed at a high frequency.

Embodiment 2

In Embodiment 1, the coefficient setting control was executed in the case where the environment fluctuation from the time of the execution of the last coefficient setting control exceeds the predetermined allowable range (Yes of S111 in FIG. 15). On the other hand, in Embodiment 2, in the case where the environment fluctuation from the time of the execution of the last coefficient setting control exceeds the predetermined allowable range, the coefficient setting control is not executed and the conversion coefficient is changed by making reference to a conversion coefficient/environment table (S124, S125 in FIG. 7). In Embodiment 2, other constitution and pieces of control are the same as those in Embodiment 1, and therefore in FIG. 17, portions common to FIGS. 5 and 7 are represented by the same reference symbols and will be omitted from redundant description.

(Primary Transfer Voltage Setting Control)

Figure 7:
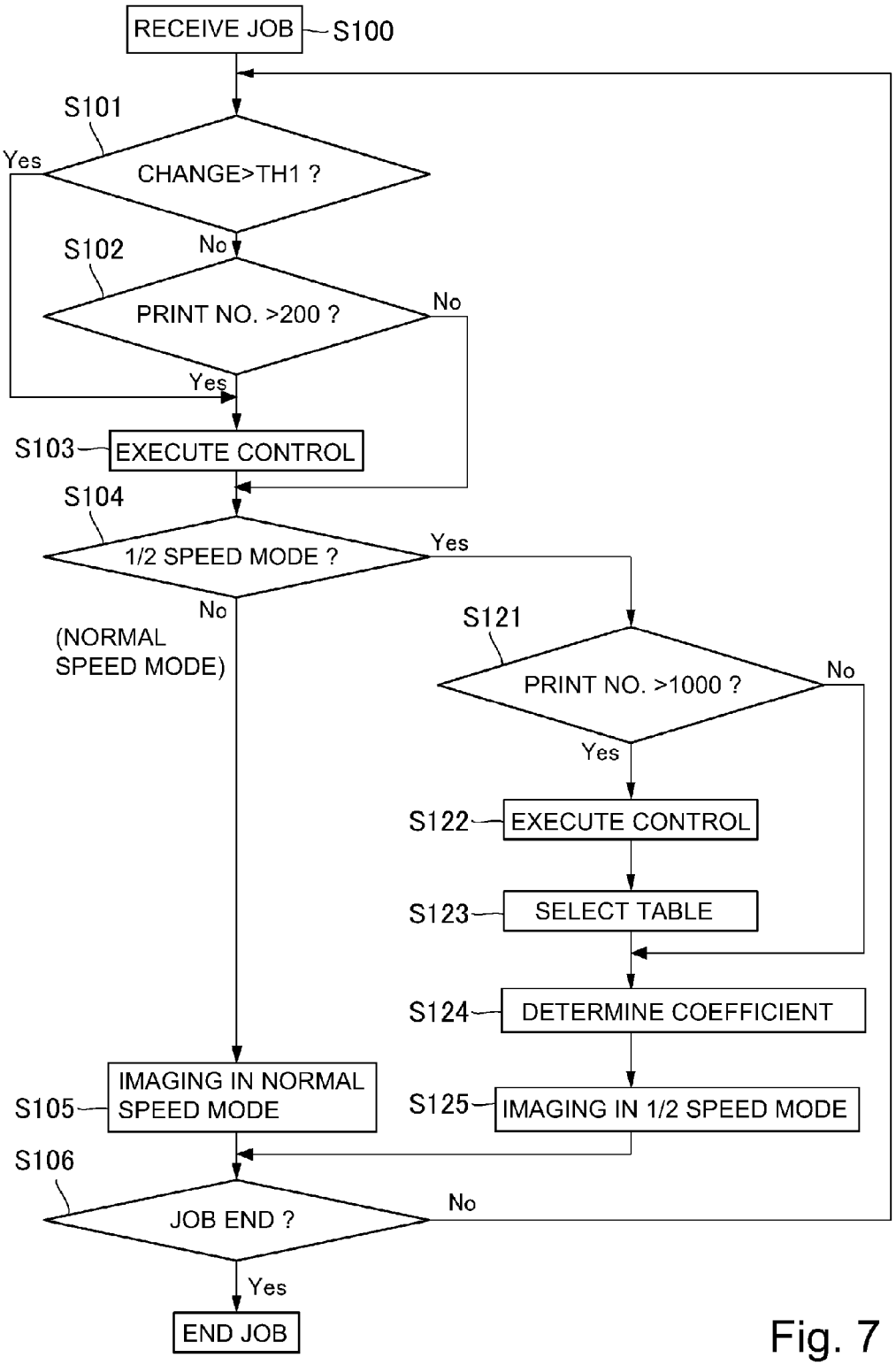
FIG. 7 is a flowchart of setting control of a primary transfer voltage is Embodiment 2.

FIG. 7 is a flowchart of primary transfer voltage setting control in Embodiment 2. As shown in FIG. 7, the controller 110 receives (job data and starts control (S100). Whether or not the voltage setting control is needed is discriminated on the basis of an environment fluctuation and a print number (S101, S102), and when the voltage setting control is needed, the voltage setting control is executed (S103).

In the case where a speed mode in the image formation intended to be executed is the ½ speed mode (Yes of S104), on the basis of the print number, the controller 110 discriminates whether or not the coefficient setting control should be executed (S121). In the case where the number of sheets subjected to the image formation after the execution of the last coefficient setting control exceeds 1000 sheets (Yes of S121), the controller 110 executes the coefficient setting control (S122).

After the execution of the coefficient setting control, the controller 110 calculates an absolute humidity of ambient air on the basis of an output of the temperature and humidity sensor 23, and selects ½ speed environment table numbers bY, bM, bC, bK at the image forming portions 1Y, 1M, 1C, 1K, respectively (S123).

The controller 110 obtains a conversion coefficient depending on the absolute humidity using the selected ½ speed environment table numbers bY, bM, bC, bK (S124).

The controller 110 multiplies the primary transfer voltage in the operation in the standard speed mode by the above-obtained conversion coefficient to determine the primary transfer voltage in the operation in the ½ speed mode, and then executes the image formation at the determined primary transfer voltage (S125).

(Conversion Coefficient/Environment Table)

Figure 8:
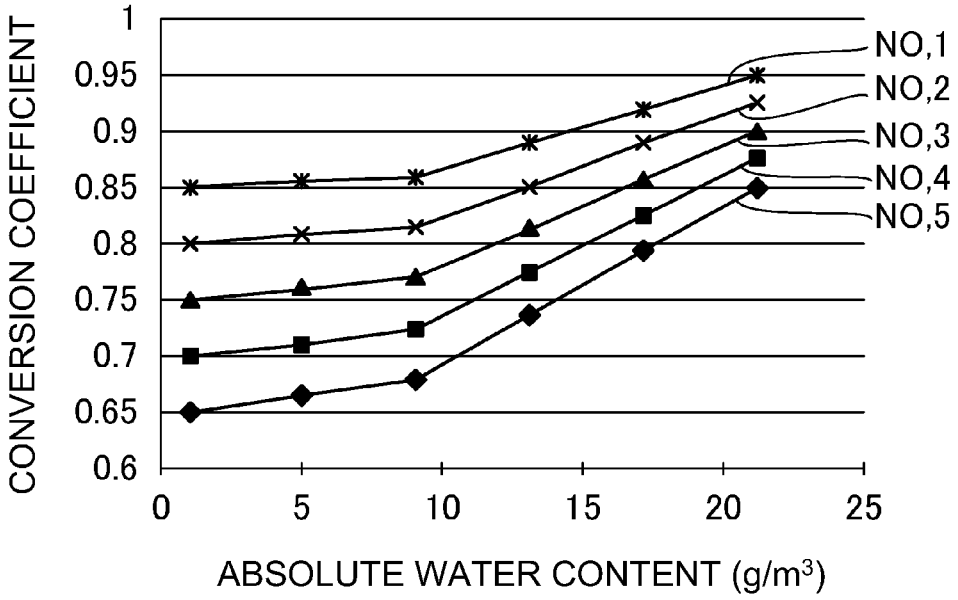
FIG. 8 is an illustration of a ½ speed environment table.

FIG. 8 is an illustration of an ½ speed environment table.

As shown in FIG. 8, the abscissa of the ½ speed environment table is an absolute humidity, and the ordinate is a conversion coefficient. The ½ speed environment table is prepared for each of the numbers (No. 1, No. 2, No. 3, No. 4, No. 5), and in which a relationship between an absolute humidity value and a conversion coefficient value is set in advance.

On the basis of an absolute humidity of the environment in which the coefficient setting control is executed and a conversion coefficient obtained in the coefficient setting control, from FIG. 8, any one of the ½ speed environment table numbers No. 1, No. 2, No. 3, No. 4, No. 5. Discrimination as the whether the conversion coefficient obtained in the coefficient setting control is closest to which one of the ½ speed environment table numbers at the absolute humidity at that time is made, so that determined that which one of the ½ speed environment table numbers should be used is made (S123).

After the execution of the coefficient setting control, in the case where the absolute humidity in the environment fluctuates, the conversion coefficient depending on the absolute humidity at that time is obtained using the ½ speed environment table for the corresponding number (S124).

In Embodiment 2, the coefficient setting control is not executed even when the environment fluctuates, and in the case where the environment fluctuates, a fluctuation in conversion coefficient due to the environment fluctuation is predicted by the ½ speed environment table. The environment fluctuation of the conversion coefficient used in the operation in the ½ speed mode is predicted in advance during the execution of the coefficient setting control, so that the execution of the coefficient setting control on the basis of the environment fluctuation is avoided. For this reason, even when the absolute humidity in the environment changes, the transfer voltage used for the image formation in the operation in the ½ speed mode can be properly maintained by the ½ speed environment table and it becomes possible to reduce a total number of times of execution of the coefficient setting control.

Other Embodiments

The present invention is not limited to the constitutions and the pieces of control described in Embodiments 1 and 2. The present invention is also applicable in embodiments in which a part or all of the constitutions and the pieces of control in Embodiments 1 and 2 are replaced. For example, in Embodiment 1, the user designates the species of the recording material (paper). However, the discrimination of the species of the recording material is not limited thereto, but may also be made automatically in the image forming apparatus by providing a recording material (paper) species detecting sensor.

In Embodiment 1, the image formation in the operation in the ½ speed mode in which the process speed is ½ of the process speed in the image formation in the operation in the standard speed mode was described. However, it is also possible to add operations in an ⅓ speed mode and an ¼ speed mode in which the process speed is decreased compared with the process speed in the operation in the ½ speed mode and to add operations in an 1.5 speed mode and a 2.0 speed mode in which the process speed is increased compared with the process speed in the operation in the ½ speed mode. Also in these cases, associated conversion coefficients are sets and may only be required to be corrected at a frequency lower than a frequency in the case of the voltage setting control.

In Embodiment 1, depending on the cumulative number of sheets subjected to the image formation, the voltage setting control timing and the coefficient setting control timing were controlled. These pieces of control may also be effected depending on a cumulative distance or a cumulative time of the image formation, the detecting mode may also be different between the voltage setting control and the coefficient setting control. As described in JP-A 2001-125338, the constant current control is effected at the first target current (second target current) and the output voltage is read, and then the primary transfer voltage in the operation in the standard speed mode (the primary transfer voltage in the operation in the ½ speed mode for calculating the conversion coefficient) may also be detected.

The controller 110 may also execute the voltage setting control irrespective of the absolute humidity when a temperature difference between the ambient temperature and the detected temperature during the last voltage setting control exceeds the first temperature difference. The controller 110 executes the coefficient setting control when a temperature difference between the ambient temperature and the detected temperature during the last coefficient setting control exceeds the second temperature difference larger than the first temperature difference.

The standard speeds of the photosensitive drum 2*a* and the intermediary transfer belt 8 are not limited to the same speed. A speed difference of about 1% may also be set between the photosensitive drum 2*a* and the intermediary transfer belt 8.

At the surface of the photosensitive drum 2*a*, a surface layer of $10^9$–$10^{14}$ Ω·cm in resistance value may also be provided. As the photosensitive drum 2*a*, an amorphous silicon photosensitive member or the like may also be employed. When the amorphous silicon photosensitive member is used, electric charge injection charging can be made, so that effects of preventing generation of ozones and of reducing electric power consumption. In addition, also a charging property is improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-007278 filed on Jan. 16, 2015, which is hereby incorporated by reference herein in its entirety.

What is claimed is:

1. An image forming apparatus comprising:

an image bearing member configured to bear a toner image;

a transfer member configured to form a transfer portion where the toner image is transferred from said image bearing member onto an intermediary transfer member;

a voltage source configured to apply a voltage to said transfer member;

a speed setting portion configured to set a speed of said image bearing member at either one of speeds including a first speed and a second speed different from the first speed;

a test mode executing portion configured to execute an operation in a test mode in which the speed of said image bearing member is set at a predetermined speed and a target voltage at which a predetermined target current corresponding to the predetermined speed is obtained from a relationship between a voltage and a current when the voltage is applied to said transfer member in a period in which the toner image does not exist at the transfer portion;

a renewing mode executing portion configured to execute an operation in a voltage renewing mode in which a first target voltage is obtained by executing the operation in the test mode at the first speed and then is renewed and further configured to execute an operation in a conversion coefficient renewing mode in which a second target voltage is obtained by executing the operation in the test mode at the second speed and a conversion coefficient is obtained from the first target voltage renewed in an immediately preceding voltage renewing mode and the second target voltage and then is renewed, wherein said renewing mode executing portion executes the operation in the voltage renewing mode at a frequency higher than a frequency of the operation in the conversion coefficient renewing mode; and a setting portion configured to set a voltage applied to said transfer member, in a period in which the toner image exists at the transfer portion when image formation is executed at the first speed, at the first target voltage renewed in an immediately preceding voltage renewing mode and further configured to set the voltage applied to said transfer member, in a period in which the toner image exists at the transfer portion when the image formation is executed at the second speed, at a voltage on the basis of the first target voltage renewed in an immediately preceding voltage renewing mode and the conversion coefficient renewed in an immediately preceding conversion coefficient renewing mode.

2. An image forming apparatus according to claim 1, wherein said renewing mode executing portion executes the operation in the voltage renewing mode at the frequency higher than the frequency of the operation in the conversion coefficient renewing mode on the basis of the number of times of cumulative image formation executed after each of execution of the operation of the last voltage renewing mode and execution of the operation of the last conversion coefficient renewing mode.

3. An image forming apparatus according to claim 2, wherein said renewing mode executing portion executes the voltage renewing mode in advance of image formation executed first at the first speed after the number of times of cumulative image formation from execution of the operation in the last voltage renewing mode exceeds a first value, and executes the conversion coefficient renewing mode in advance of image formation executed first at the second speed after the number of times of cumulative image formation from execution of the operation in the last conversion coefficient renewing mode exceeds a second value larger than the first value.

4. An image forming apparatus according to claim 1, further comprising a detecting member configured to detect an ambient temperature of said image forming apparatus, wherein said renewing mode executing portion executes the operation in the voltage renewing mode when a difference between a present detection result of said detecting member and a detection result of said detecting member during execution of the operation in the last voltage renewing mode is larger than a first threshold.

5. An image forming apparatus according to claim 1, further comprising a detecting member configured to detect an ambient temperature of said image forming apparatus, wherein said renewing mode executing portion executes the operation in the voltage renewing mode when a difference between a present detection result of said detecting member and a detection result of said detecting member during execution of the operation in the last voltage renewing mode is larger than a first threshold, and executes the operation in the conversion coefficient renewing mode when an difference between the present detection result of said detecting member and a detection result of said detecting member during execution of the operation in the last conversion coefficient renewing mode is larger than a second threshold larger than the first threshold.

6. An image forming apparatus according to claim 1, wherein the second speed is lower than the first speed.

7. An image forming apparatus according to claim 1, wherein a frequency of image formation executed at the second speed is lower than a frequency of image formation executed at the first speed.

8. An image forming apparatus according to claim 1, further comprising a fixing device configured to fix the toner image on a recording material by heating the recording material on which the toner image is transferred from said intermediary transfer member, wherein a thickness of the recording material used for image formation executed at the second speed is thicker than a thickness of the recording material used for image formation executed at the first speed.

* * * * *